United States Patent [19]

Svagr

[11] Patent Number: 4,686,845

[45] Date of Patent: Aug. 18, 1987

[54] ROLL STAND, WITH TRAVELING CARRIAGE CONTAINING THE SET OF ROLLS WHICH CAN BE RUN OUT OF AND BACK INTO SAID STAND TRANSVERSELY TO THE DIRECTION OF ROLLING

[75] Inventor: Alexandr Svagr, Hilden, Fed. Rep. of Germany

[73] Assignee: SMS Schloemann-Siemag Aktiengesellschaft

[21] Appl. No.: 779,670

[22] Filed: Sep. 24, 1985

[30] Foreign Application Priority Data

Oct. 4, 1984 [DE] Fed. Rep. of Germany ..... 3436325

[51] Int. Cl.[4] ..... B21B 31/04; B21B 31/10

[52] U.S. Cl. ..... 72/238; 72/237; 72/239

[58] Field of Search ..... 72/238, 237, 239, 247, 72/241

[56] References Cited

U.S. PATENT DOCUMENTS

| | | | |
|---|---|---|---|
| 3,587,278 | 6/1971 | Kracht | 72/237 |
| 3,733,876 | 5/1973 | Hlafcsak | 72/239 |
| 3,946,587 | 3/1976 | Maltby | 72/237 |
| 3,949,586 | 4/1976 | Neumann | 72/238 |
| 4,182,149 | 1/1980 | Wilson | 72/247 |

FOREIGN PATENT DOCUMENTS

| | | | |
|---|---|---|---|
| 0971409 | 9/1964 | United Kingdom | 72/248 |

*Primary Examiner*—Robert L. Spruill
*Assistant Examiner*—Steve Katz
*Attorney, Agent, or Firm*—Toren, McGeady & Associates

[57] ABSTRACT

A rolling mill stand with roll housings (1, 2) through the window formed by the pillar transoms of the one roll housing (2), the set of rolls (7, 8) together with the bearing installation parts as well as the rest bar (17) and the roller fittings connected therewith can be driven out of and back again into the rolling mill stand on a traveling carriage with rollers (14) on rails (15). One of the two roll housings (2), or the two pillar transoms together with the ground traverse connecting them or the two pillar transom sections (*2a, 2b*) bordering the window on the driving-out side, constitute hereby an autonomous component superimposed on the traveling carriage and separable from the rolling mill stand.

2 Claims, 3 Drawing Figures

ROLL STAND, WITH TRAVELING CARRIAGE CONTAINING THE SET OF ROLLS WHICH CAN BE RUN OUT OF AND BACK INTO SAID STAND TRANSVERSELY TO THE DIRECTION OF ROLLING

BACKGROUND OF THE INVENTION

1. Field of the Invention

The invention is directed to a rolling mill stand with a traveling carriage, comprising a set of rolls together with bearing installation parts as well as a rest bar and the roll fittings connected therewith, said traveling carriage being drivable out of and back into the stand transversely to the direction of rolling through a window formed by the pillar transoms of one of the roll housings.

2. Description of the Related Art

In the design of such rolling mill stands, there result difficulties, if the roll fittings consist, for instance, of roll guides superimposed upon the rest bars, which require a comparatively large support housing. The dimensions of theses housings are frequently so great, that they, together with the traveling cartridge, cannot be driven through windows in the rolling mill stands even if these windows have been widened up to the possible limits. The roll guides and, as a rule, together with these the rest bars have, therefore, either to be removed prior to driving out the roll set or, instead of rolls set which could be driven out, a replacement stand is utilized, meaning the entire roll stand is replaced by another one.

SUMMARY OF THE INVENTION

The invention is based upon the task to improve a rolling mill stand of the species-like design in such a way that the possibility is given to drive the set of rolls together with the roll installation parts, the rest bar and the roll fittings arranged thereon, for instance roll guides with large housings, independently of their structural dimensions, out of the rolling mill stand and again back into the same on the traveling carriage. Starting with the known design of rolling mill stands, in which, for the purpose of removal of the rolls, a top connecting the two roll stands can, after loosening and swinging out of the tensionable tie rods, be lifted out from longitudinal recesses of the roll housing, open in the direction of rolling and subsequently the rolls could also be removed towards the top, the inventive solution of this task consists in that one of these two roll stands, or the two pillar transoms and the lower housing yoke connecting the same, or the pillar transom sections bordering the window pointing in the driving out direction, constitute an independent component superimposed upon the traveling carriage and separable from the roll stand. The two pillar transom sections can be connected rigidly or detachably with each other by means of lateral crossbars running above and below the window and thereby, possibly, the lateral crossbar above the window arched outward in balcony-fashion can comprise a pass-through opening for permitting the passage of the segment of the journal of the rolls located below. Here the arrangement can be such that the pillar sections above and below the separable pillar transom sections comprise, in direction of rolling, open longitudinal recesses for acceptance of the pivotable and tensionable tie rods articulated in the roll housing. The roll housing section above the separable pillar transom sections is appropriately connected solidly with the other rolling stand by means of a yoke traverse. The adjusting flaps for the axial roll adjustment are, as the invention provides further, articulated at the pillar transom sections, which can be driven out of the rolling stand on the traveling carriage.

The inventive solution permits to drive roll fittings of practically any width, meaning also widths exceeding the width of the housing itself, without difficulties, together with the rest bar, the set of rolls, and the adjusting flaps, out of the roll stand and to exchange the same with another set of rolls with the appropriate fittings. The set of rolls to be newly installed can thereby already be completely prepared and adjusted for the rolling operation prior to driving them into the roll stand. In particular, also the axial adjustment of the rolls can already be performed with the help of the adjustment flaps articulated at the pillar transom sections, prior to driving the set of rolls again into the roll stand. The disassembly, respectively, the assembly of the set of rolls located on the traveling carriage outside of the stand, can thereby be performed so that the pillar transom sections connected with each other by the lateral traverses can be pulled off the traveling carriage and then the rolls can be lifted off one after the other, and also, if the pillar transoms remain on the traveling carriage, in such a way that the rolls are removed vertically towards the top, whereby the journal sections of the rolls pass through the pass-through opening of the balcony-like arching of the upper lateral traverse of the pillar transom sections.

BRIEF DESCRIPTION OF THE DRAWINGS

The invention is described in the following with particularity with the help of the embodiment example depicted in the drawings, in which.

DESCRIPTION OF THE PREFERRED EMBODIMENT

Figure 1:
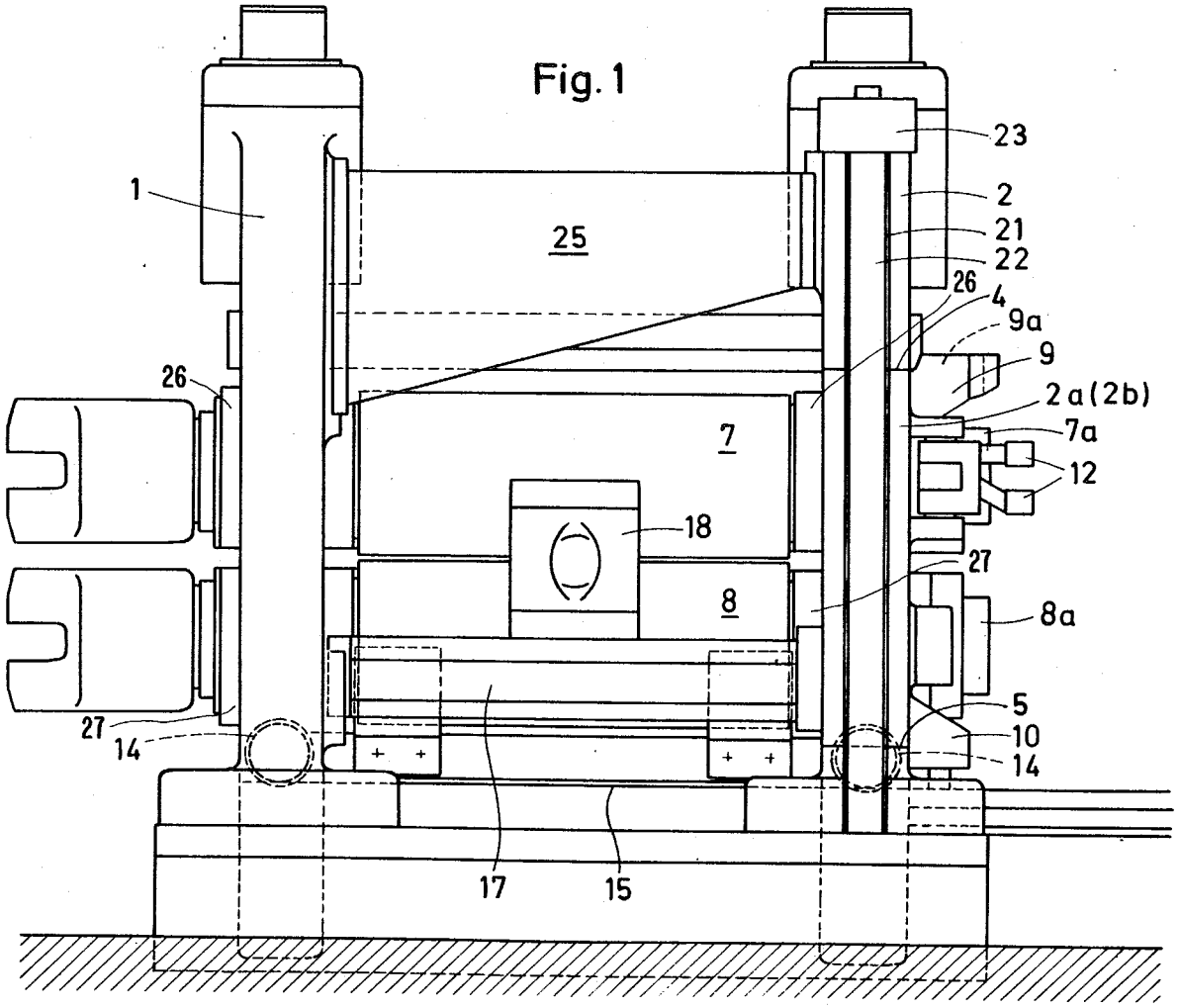
FIG. 1 is an elevation view of the roll stand when viewed in direction of rolling.
Figure 2:
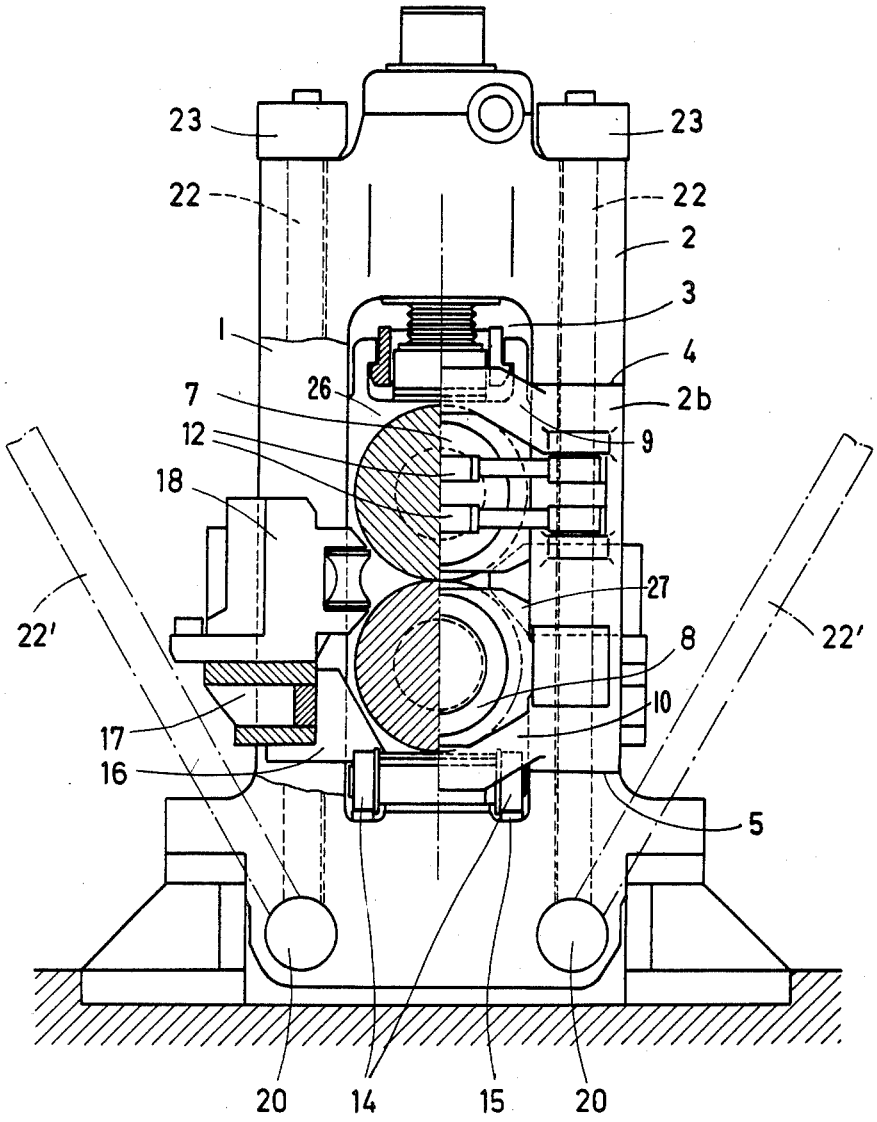
FIG. 2 is a side view of the roll stand shown in FIG. 1.

As can be discerned from FIGS. 1 and 2, the rolling mill stand consists of a roll housing 1 on the drive side and a roll housing 2 on the operator's side. The pillar transom sections 2*a* and 2*b* bordering the window 3 constitute an autonomous component, which is separable from the other portions of the rolling mill stand at the parting lines 4 and 5. The pillar transom sections 2*a* and 2*b* are connected with each other above and below the rolls 7 and 8 by means of lateral traverses 9 and 10; they can hereby constitute with these a one-piece frame, or the lateral traverses 9 and 10 can be connected with the pillar transom sections 2*a*, 2*b* so as to be detachable. Adjusting flaps 12 are articulated externally at the pillar transom sections 2*a*, 2*b*, with which the rolls 7 and 8 can be axially displaced. The pillar transom sections 2*a*, 2*b* together with the rolls 7 and 8 are arranged on a traveling carriage 16 which here travels on rollers 14 upon rails 15, said carriage 16 being, at the same time, the support of the rest bar 17 with the superimposed roll guides 18. The tie rods 22, hinged at the foot of the roll housing by means of articulations 20 and lying in open longitudinal recesses 21 of the roll housing 2 and the pillar transom sections 2*a*, 2*b*, together with the hydraulically actuatable tensioning cylinder aggregates 23 sitting on the free ends of said tie rods 22 can be swung together with the cylinder aggregates 23 out of the vertical position in the longitudinal recesses 21, (compare FIG. 2) into the position 22' indicated with dash-dotted lines. In any position, the traveling carriage 16 with the two pillar transom sections *2a, 2b,* the two rolls 7, 8, the rest bar 17 and the roll guides 18 can be driven out of the rolling mill stand, whereby the constructional width of the roll guides 18, discernible from FIG. 2, does not present any obstacle. The roll housing section of roll housing 2 above the parting line 4, which is solidly connected with the other roll housing 1 by means of a traverse boom 25, remains hereby in the situation as indicated in the drawing.

Figure 3:
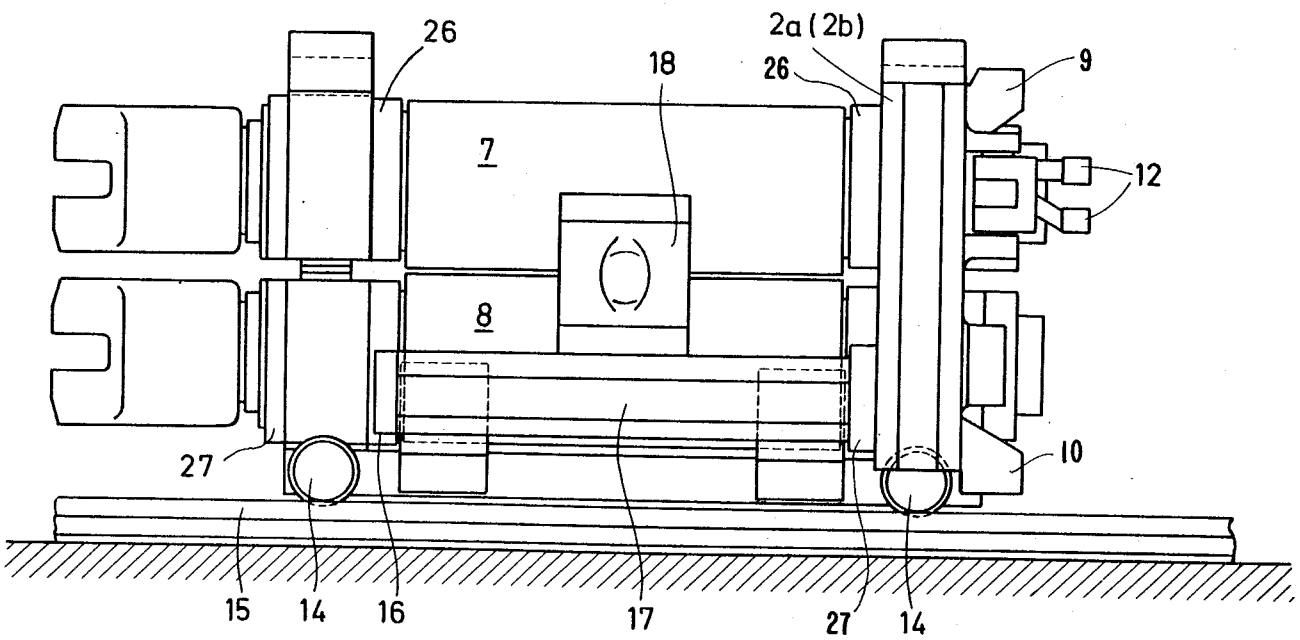
FIG. 3 is an elevational view of the driven out set of rolls, also viewed in direction of rolling.

The traveling carriage 16 depicted in FIG. 3 driven out of the rolling mill stand together with the rolls 7, 8, the pillar transom sections *2a, 2b,* the rest bar 17, the roll guides 18 as well as the roll installation parts 26,27 and the adjustment flaps 12 articulated at the pillar transom sections *2a, 2b,* can, after it has been driven out of the rolling mill stand, be exchanged with another correspondingly equipped traveling carriage, which then, after it has been driven back into the rolling mill stand, after the tie rods 22 have been swung back and after the section of the roll housing 2 left in the rolling mill stands has been clamped with the pillar transom sections *2a, 2b,* renders the rolling mill stand complete and ready for work, without special additional adjustment being required, since this has already been previously accomplished outside of the stand at the set of rolls 7,8, the adjustment flaps 12 and the roll guides 18.

The traverse 9 (compare FIG. 1) exhibits a pass-through recess *9a,* through which, if the set of rolls 7,8 is driven out of the rolling mill stands, the journal section *7a* or *8a* pass through vertically towards the top.

I claim:

1. A rolling mill stand comprising roll housings including pairs of pillar transoms (1, 2) connected together and forming windows, a set of rolls (7, 8) having a rolling direction between said set of rolls, roll installation parts (26, 27) associated with said rolls, a travelling carriage (16) movable transversely to the rolling direction of said rolls, said set of rolls and associated roll installation parts mounted on said travelling carriage, said roll installation parts (26, 27) connected together by a rest bar (17), roll fittings (18) mounted on said rest bar (17), one of said pairs of pillar transoms (2) comprises pillar transom sections interconnected by lateral traverses (9, 10) extending above and below said set of rolls (7, 8), sections of the roll housing (2) above and below the detachable pillar transom sections (*2a, 2b*) have longitudinal recesses (21) formed therein open in the direction of rolling for receiving tensionable tie rods (22), said tensionable tie rods being articulated at the roll housing (2) including said pillar transom section, a section of one of the roll housings (2) above the separable pillar transom sections (*2a, 2b*) is solidly connected with the other roll housing (1) by a traverse yoke (25), said pillar transom sections and lateral traverses mounted on said travelling carriage whereby said travelling carriage along with said set of rolls, roll installation parts, pillar transom sections and lateral traverses can be detached from said roll housings and removable therefrom on said travelling carriage.

2. Rolling mill stand according to claim 1, characterized in that one of the lateral traverses (9) is formed to arch outwardly above the set of rolls (7, 8) and includes a pass-through recess (*9a*)for the vertical passage of journal sections (*7a, 8a*) of the rolls (7, 8).

* * * * *